US012134901B2

(12) United States Patent
Carnes

(10) Patent No.: US 12,134,901 B2
(45) Date of Patent: Nov. 5, 2024

(54) DOOR JAMB POSITIONING TOOL

(71) Applicant: John Carnes, Lynden, WA (US)

(72) Inventor: John Carnes, Lynden, WA (US)

( * ) Notice: Subject to any disclaimer, the term of this patent is extended or adjusted under 35 U.S.C. 154(b) by 429 days.

(21) Appl. No.: 17/690,198

(22) Filed: Mar. 9, 2022

(65) Prior Publication Data

US 2023/0304306 A1 Sep. 28, 2023

(51) Int. Cl.
*E04F 21/00* (2006.01)

(52) U.S. Cl.
CPC ..... *E04F 21/003* (2013.01)

(58) Field of Classification Search
CPC ..... E04F 21/003
USPC ..... 33/194, 197
See application file for complete search history.

(56) References Cited

U.S. PATENT DOCUMENTS

X2805 I1 * 6/1817 Bliss ..... E04F 21/003 33/194
408,496 A * 8/1889 Macker ..... E04F 21/003 33/194
441,522 A * 11/1890 Watson ..... E04F 21/003 33/194
3,242,580 A * 3/1966 Crawford ..... E04F 21/26 30/372
3,851,868 A * 12/1974 Lagasse ..... E04F 21/0015 269/208
3,992,833 A * 11/1976 Hulinsky ..... E06B 1/603 49/505
4,400,886 A * 8/1983 Bindschatel ..... B27F 5/12 D10/64
4,499,666 A * 2/1985 Smith ..... B25H 7/02 33/476
4,955,521 A * 9/1990 Michael ..... B27F 7/003 144/353
5,433,009 A * 7/1995 Keels, Jr. ..... E04F 21/003 33/562
6,230,413 B1 * 5/2001 Reiley ..... E04F 21/003 33/194
6,237,300 B1 * 5/2001 Carne ..... E04B 2/58 52/657
6,442,853 B1 * 9/2002 Hale ..... G01C 9/28 33/365
6,553,683 B1 * 4/2003 Klass ..... E04F 21/18 33/456
6,615,500 B2 * 9/2003 Hale ..... G01C 9/28 33/365
6,763,639 B2 * 7/2004 Bennett ..... E06B 3/9632 49/504
7,410,180 B1 * 8/2008 Nguyen ..... F16D 55/02 280/47.11
7,752,762 B2 * 7/2010 King, IV ..... E05B 17/06 33/562
7,793,421 B2 * 9/2010 Hardy ..... G01B 3/08 33/809

(Continued)

*Primary Examiner* — George B Bennett
(74) *Attorney, Agent, or Firm* — Cynthia S. Lamon; Lamon Patent Services

(57) ABSTRACT

A jig for positioning door jambs has a base template and an alignment rail each part including opposing notch patterns and locator pin patterns, the alignment rail assembled to the base template and adjustable to travel via slots in the base template to enable stacking a pair of door jambs in correct configuration inside a constructed doorway for installation to the constructed doorway frame members.

19 Claims, 4 Drawing Sheets

(56) References Cited

U.S. PATENT DOCUMENTS

| | | | | |
|---|---|---|---|---|
| 8,832,949 | B2 * | 9/2014 | Allen | E06B 1/04 33/194 |
| 9,428,923 | B1 * | 8/2016 | Christner | E04F 21/0015 |
| 10,138,673 | B1 * | 11/2018 | Chapman | E05D 11/00 |
| 11,542,734 | B1 * | 1/2023 | Gunkler | E05C 17/02 |
| 11,732,524 | B2 * | 8/2023 | Gordon | E04F 21/0015 52/213 |
| 2002/0170189 | A1 * | 11/2002 | Cheatham | G01C 15/12 33/645 |
| 2005/0210689 | A1 * | 9/2005 | Carroll | E04F 21/0015 33/194 |
| 2008/0047152 | A1 * | 2/2008 | Wilding | E04F 21/0015 33/194 |
| 2008/0142119 | A1 * | 6/2008 | Ponce | B23Q 9/0042 144/144.51 |
| 2018/0186028 | A1 * | 7/2018 | Ponce | B25H 7/02 |
| 2019/0271174 | A1 * | 9/2019 | Van Kampen | E05B 15/0205 |
| 2020/0325692 | A1 * | 10/2020 | Carroll | E04F 21/0015 |
| 2021/0316182 | A1 * | 10/2021 | Kendall | A63B 21/1636 |
| 2023/0349224 | A1 * | 11/2023 | Gordon | E06B 1/02 |
| 2023/0366256 | A1 * | 11/2023 | Seppanen | E06B 1/34 |

* cited by examiner

DOOR JAMB POSITIONING TOOL

BACKGROUND OF THE INVENTION

1. Field of the Invention

The present invention is in the field of construction and pertains particularly to methods and apparatus for positioning door jambs for installation to frame members of a constructed doorway.

2. Discussion of the State of the Art

In the art of construction, doors are installed to door jambs, which are in turn installed to doorway framing members. It is critical that door jambs are set in the correct positions for subsequent installation of a door. In current art, workers perform measuring tasks and marking tasks to ensure that they place the jambs in the correct positions before a door is hung in the doorway. The requirement for measuring and marking for every dimension adds a lot of task work to the job. In construction code, doorway frames are typically all set at prescribed widths and face alignments with one another (left, right).

Therefore, what is clearly needed is a jig that may be used to preset door jambs into correct positions for install to doorway frame members.

BRIEF SUMMARY OF THE INVENTION

According to an embodiment of the present invention, a jig is provided for positioning door jambs for installation to a constructed doorway comprising a base template having a length, a width, and a height, the base template including side walls formed along the long edges of the base template material creating the height dimension, a first pair of board locator pins spaced apart and parallel to one another mounted on the base template above the top surface of the base template, the pattern of the locator pins centered on the base template relative to the length of the base template, a first pair of notch patterns disposed at opposing ends of the base template in mirror image to one another and aligned horizontally, each notch pattern adapted to conform to a step profile of a door jamb on one side of the constructed doorway, a pair of slots placed through the surface wall of the base template, the slots spaced apart and held parallel to one another, the pattern of the mounting slots centered relative to the length of the base template and the pattern of the board locator pins, an alignment rail having a length, width, and height, the alignment rail including a side wall along one edge, the alignment rail adjustably mounted on the base template at the pair of slots using nut and bolt fasteners, a second pair of locator pins spaced apart and parallel to one another mounted on the alignment rail a distance above the top surface of the alignment rail, the pattern of the locator pins centered on the alignment rail relative to the length of the alignment rail, the second pair of locator pins having the same dimensions and spacing as the first pair of locator pins, and a second pair of notch patterns disposed at opposing ends of the alignment rail in mirror image to one another and aligned horizontally, each notch pattern adapted to conform to the step profile of the door jambs positioned for installation.

In one embodiment, the base template and alignment rail are manufactured of aluminum sheet metal of a uniform thickness. In a preferred embodiment, the length of the base template is greater than the width dimension of the constructed doorway, and wherein the outside edges of the first pair of locator pins brush the inside surfaces of the vertical doorway frame members centering the base template within the constructed doorway. In a preferred embodiment, the length of the alignment rail is greater than the width dimension of the doorway frame, and wherein the outside edges of the second pair of locator pins brush the inside surfaces of the vertical doorway frame members centering the alignment rail within the doorway frame.

In one embodiment, the first and second pair of locator pins are welded to the base template and alignment rail respectively. In another embodiment, the first and second pair of locator pins are mechanically mounted to the base template and alignment rail respectively. In a variation of this embodiment, the first and second pair locator pins are attachable and detachable to their respective mounting locations. In one embodiment, the pair of bolts are turn knobs that thread into nuts through one or more washers.

In one embodiment, the jig further includes four leveler points disposed two to each side wall of the base template, the leveler points contacting the floor when the jig is in use. In a preferred embodiment, the first and second pairs of notch patterns conform to the stepped sides of the door jambs. In one embodiment, the locator pins are annular. In an alternative embodiment, the locator pins are rectangular. In a preferred embodiment, the first and second pairs of locator pins align with one another in the jig when the jig is fully assembled. In one embodiment, the first and second pair of locator pins are individually pivotally mounted and may be locked horizontal or unlocked and pivoted upward.

In one embodiment, the is adapted by the notch patterns for a door jamb with a double-step profile having a center raise defining the thickness dimension of the door jamb. In another embodiment, the jig is adapted by the notch patterns for a door jamb with a single-step profile having an edge raise defining the thickness dimension of the door jamb. In a preferred embodiment, before tightening the alignment rail to the base template, the alignment rail is urged along the slot track in the base template to stack both door jambs to the opposing notch patterns in the base template.

In a preferred embodiment, bolt openings are provided through the alignment rail, the spacing of the bolt openings in the alignment rail substantially equal to the spacing of the slots in the base template. In one embodiment, the alignment rail is installed to the base template to stack the door jambs and removed from the base template after the door jambs are installed to the constructed doorway.

DETAILED DESCRIPTION OF THE INVENTION

In various embodiments described in enabling detail herein, the inventor provides a unique two-piece jig for staging door jambs relative to location and orientation (proper spacing and alignment) for install to vertical doorway studs in a doorway. A goal of the present invention is to reduce measuring and marking tasks associated with locating door jambs relative to vertical studs of a doorway before installation. The present invention is described using the following examples, which may describe more than one relevant embodiment falling within the scope of the invention.

Figure 1:
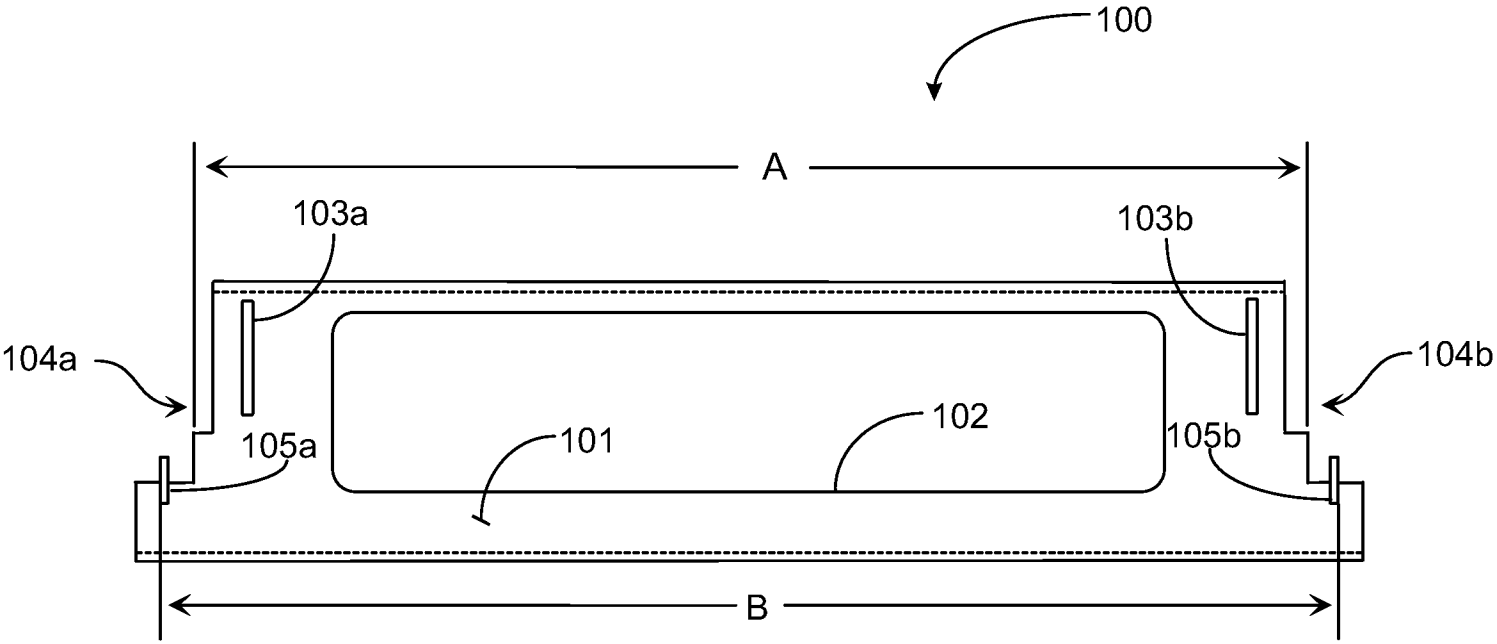
FIG. 1 is an overhead view of a base jig template for staging door jambs in initial position for installation according to an embodiment of the present invention.

FIG. 1 is an overhead view of a base jig template 100 for staging door jambs in initial position for installation according to an embodiment of the present invention. Base template 100 is one piece of a two-piece jig (second piece depicted in FIG. 2). Base template 100 is adapted to be placed in between erected vertical studs defining the side frame members of a typical construction doorway that is regulated by code in the art of construction. Base template 100 may be fabricated from a stiff aluminum sheet metal having a sheet thickness of at least three sixteenth of an inch or stock 087 thousandths of an inch thickness.

In one embodiment, base template 100 is fabricated from steel. Base template 100 has a top surface 101 that is a raised surface with reference to ground level. Base template 100 is rectangular in form wherein the longest opposing edges of template are formed orthogonally downward a strategic fold distance to form two downward facing edges uniform in height resulting in the raised surface 101 with respect to ground level. The downward facing feet are not visible in this overhead view but are indicated in this view by broken lines and are visible in a latter view of this specification. Base template 100 includes a large, elongated opening 102 created by material removal disposed proximal to the center region of the template. Opening 102 may be termed a lightening hole for reducing weight of the jig and reducing the tendency of warping in the jig.

Base template 100 includes a pair of board locator pins 105*a* and 105*b*. Locator pins 105*a* and 105*b* are welded or otherwise mechanically fixed to raised surface 101 in a direction orthogonal to the longitudinal center line of base template 100. Locator pins 105*a* and 105*b* are positioned at some distance above raised surface 101 and are spaced apart such that a spacing distance B is equal to the code width dimension of a constructed doorway. Locator pins 105*a* and 105*b* are parallel to one another and spaced apart to touch the vertical frame member or "door frame" at each side on the outside edges when base template 100 is inserted within the doorway from the correct side that a door will be eventually hung.

The overall length of base template 100 is longer than the width of the constructed doorway frame in terms of code dimension. In a preferred embodiment, base template 100 is fabricated specifically for a specific width of the constructed doorway, minus doorway jambs, and which may be dependent upon construction code widths. Board locator pins 105*a* and 105*b* may be steel or aluminum annular pins, or rectangular bars without departing from the spirit and scope of the invention. In one embodiment, locator pins 105*a* and 105*b* are mechanically connected to base template 100 using a pivot mount (not illustrated) and may be locked in a horizontal orientation and unlocked to pivot upward. In one embodiment, locator pins 105*a* and 105*b* are detachable from base template 100.

Base template 100 includes a pair of orthogonal through slots 103*a* and 103*b*. Through slots 103*a* and 103*b* are parallel to one another and are of a uniform length and width. Slots 103*a* and 103*b* is centered with respect to the overall width of base template 100. Slots 103*a* and 103*b* are adapted to accept a bolt pattern placed through a second part of the jig in the form of a locator rail (not illustrated) that may be attached to base template 100 using the slots and typical hardware (bolts and nuts). Base template 100 is placed against the doorway frame opening with locator pins 105*a* and 105*b* residing just inside of the finished vertical frame members of the constructed doorway thus, the tool is centered within the constructed doorway with little to no dimensional play to move the template side-to-side. The locator pins 105*a* and 105*b* may be fixed on the base template with the code width of the doorway as a measurement from outside edge to outside edge of the pair. It is noted herein as well that the pattern of locator pins 105*a* and 105*b* is centered longitudinally on base template 100.

Base template 100 is notched uniformly at both edges to form a shape profile at each end of the template for orientating each door jamb in the correct edge position for install. Locator pins 105*a* and 105*b* may serve as locator pins for the outside surfaces (long edge) of the door jambs correctly orientated within the base template. Notch patterns include notches 104*a* and 104*b*. Notches 104*a* and 104*b* function to locate the inside surfaces of the opposing door jambs according to step profile in this example. Therefore, the distance between the inside edge of locator pin 105*a* and notch pattern 104*a* is roughly equal to the thickness dimension of the door jamb (within tolerance). The notched surfaces of door jamb notches 104*a* and 104*b* are parallel (opposing mirror image patterns) and orthogonal to the longitudinal center line of base template 100. Similarly, the long edges of the base template are parallel to one another and to the longitudinal center line of base template 100. In one embodiment, the notch patterns may profile a different shape owing to a different configuration of door jamb.

In construction, there may be two or more different door jamb configurations that are dimensionally constant with current construction codes. However, a notch pattern in a base template like base template 100 may be fabricated or modified for a custom shape door jamb that meets construction code if required. Typically, in a construction environment, the doorway width and the door jamb style will be a consistent metric within a given construction project, for example, one home, or a plurality of homes, built by the home builder in the same construction project. It is noted herein the door jambs are typically edge-flush to the doorway frame members on the side where the door will open and close. Therefore, base template 100 is inserted between and against the doorway frame from the side supporting the door or doors. A width dimension A is equal to the width of the door that will be hung in the doorway with finished door jambs installed.

Figure 2:
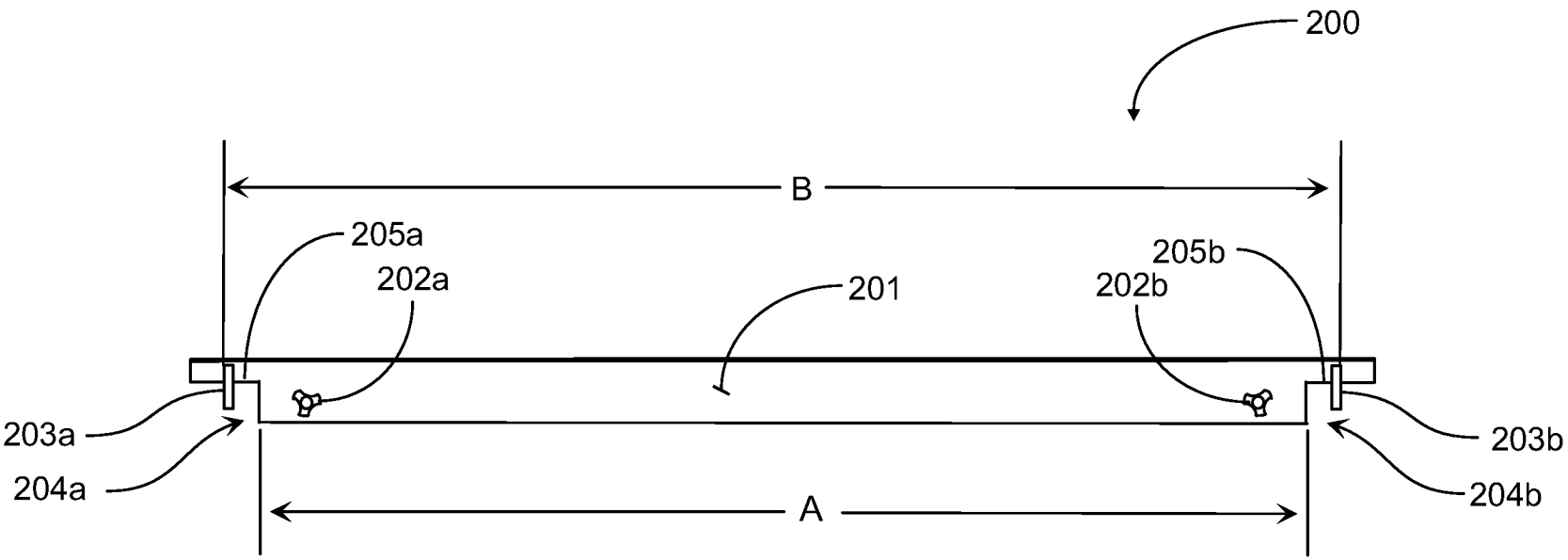
FIG. 2 is an overhead view of a top jig alignment rail for checking alignment of door jambs positioned for installation according to an embodiment of the present invention.

FIG. 2 is an overhead view of a top jig jamb alignment rail 200 for checking and creating proper alignment of door jambs positioned for installation according to an embodiment of the present invention. Alignment rail 200 is manufactured of the same material (aluminum or steel) described above with reference to base template 100. Alignment rail 200 is a bracket shaped rail having a right-angle side profile in a preferred embodiment, and a top horizontal surface 201. Alignment rail 200 includes a pair of hand-operated turn knobs described herein as a turn knob 202*a* and a turn knob 202*b*. Turn knobs 202*a* and 202*b* are internally threaded and include matching bolts that may be inserted through the bottom template through slots 103*a* and 103*b* (see FIG. 1) when attaching rail 200 to base template 100 of FIG. 1 to assemble the full jig.

In another hardware embodiment, turn knobs 202*a* and 202*b* are welded at center to male threaded bolts wherein a female nut and washer is provided to thread onto each of the bolts. In the latter case, the bolts having turn knobs are inserted through openings provided for the purpose in the horizontal surface of rail 200 wherein the openings line up with the slots in base template 100 and the washers and nuts are disposed beneath the base template and applied to tighten rail 200 to a position on base template 100. Rail 200 may remain loosely tightened until the rail is urged along the slots against the door jambs oriented in base template 100 and aids a user in stacking the door jambs back flush against the respective notches (104*a* and 104*b*, FIG. 1) in base template 100. At that point the knobs may be fully tightened locking the alignment rail 200 in the proper place over base template 100. The fully assembled jig may then be used for the rest of the doorways requiring door jamb installation in the construction project assuming of course a consistent door width and jamb style.

Alignment rail 200 includes a pair of board locator pins referenced herein as a board locator 203*a* and a board locator pin 203*b*. Board locator pins 203*a* and 203*b* are parallel with one another and spaced part to equal the spacing orientation and longitudinal dispersal of board locator pins 105*a* and 105*b* introduced in FIG. 1. Likewise, board locator pins 203*a* and 203*b* may be welded or otherwise fixed to the tool. Board locator pins 203*a* and 203*b* share distance B with board locator pins 105*a* and 105*b* of base template 100 (FIG. 1). In one embodiment, locator pins 203*a* and 203*b* are mechanically connected to alignment rail 200 using a pivot mount (not illustrated) and may be locked in a horizontal orientation and unlocked to pivot upward. In one embodiment, locator pins 203*a* and 203*b* are detachable from alignment rail 200.

Alignment rail 200 may be notched at both ends according to the shape profile of the door jambs. The notches are represented herein as a notch 204*a* and a notch 204*b*. Notches 204*a* and 204*b* share distance A with notches 104*a* and 104*b* of base template 100. Distance B is the width between the frame members of the constructed doorway, and distance B is the width of the door to be hung after the door jambs are installed. Alignment rail 200 is adapted to slide along slots (tracks) 103*a* and 103*b* of base template 100 (FIG. 1). Notches 204*a* and 204*b* include back edges 205*a* and 205*b*. Back edges 205*a* and 205*b* function as stops against the opposing edges of the door jambs and the opposing edges of the constructed doorway thus holding the door jambs aligned in mirror image from one another in the two-piece jig. In practice and in this embodiment, the door jambs have a width dimension roughly equal to the individual width dimensions of the doorway frame members.

Figure 3:
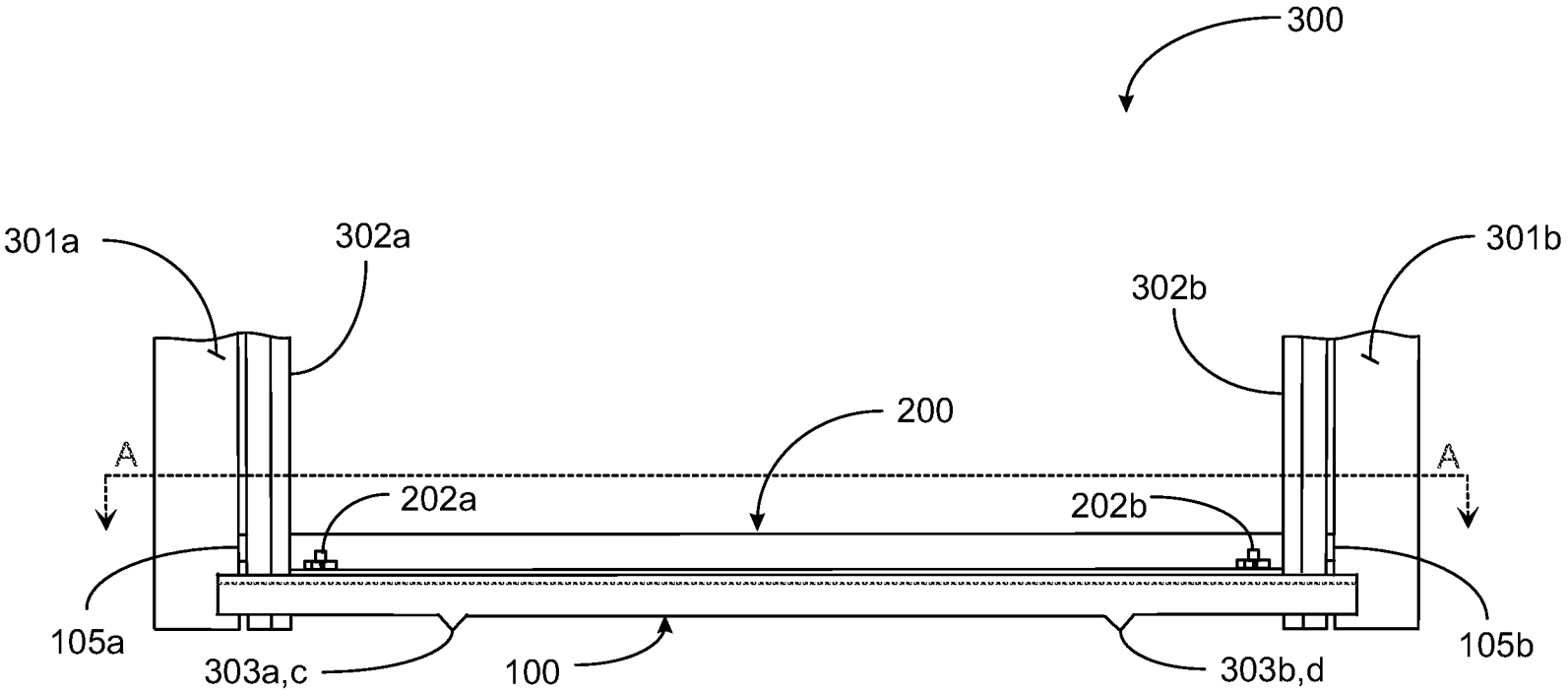
FIG. 3 is an elevation view of a jig assembly comprising the base jig template of FIG. 1 supporting the alignment rail of FIG. 2 adjusted and tightened to position door jambs at proper spacing and alignment for install to frame members of a doorway.

FIG. 3 is an elevation view of a jig assembly 300 comprising the base jig template 100 of FIG. 1 supporting the alignment rail 200 of FIG. 2 adjusted and tightened to position door jambs for installation to frame members of a doorway. Jig assembly 300 is depicted in elevation view with alignment rail 200 attached to and tightened down against base template 100 using hand turn knobs 202*a* and 202*b*. Doorway frame members 301*a* and 301*b* are depicted in this view as well as a pair of door jambs 302*a* and 302*b* held in a jigged position at proper spacing and alignment for installation to doorway frame members 301*a* and 301*b*.

Jig assembly 300 includes four leveler points 303 (a,b,c,d) for avoiding anomalies in the flooring around the doorway frame that might otherwise create a tip or rocking tendency in the jig base template. Leveler points 303 (a-d) provide sure footing contact for the jig to ground and reduces the tendency for base jig template 100 to slide. In this view, board locator pins 105*a* and 105*b* of base template 100 are visible where locator pins 203*a* and 203*b* on alignment rail 200 are not visible because they occupy the same alignment spacing behind the visible pins. The locator pins maintain a uniform gap between the doorway frame member and the installed door jamb.

Figure 4:
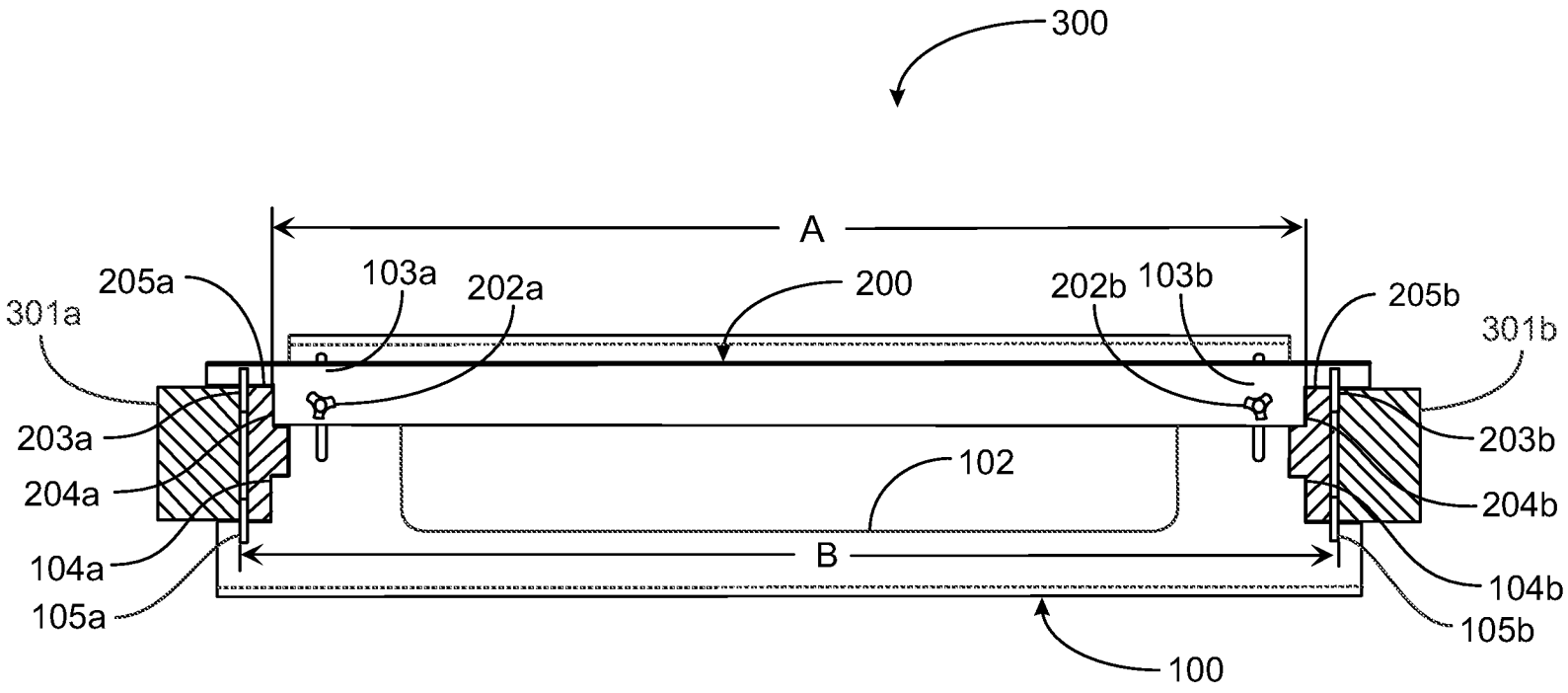
FIG. 4 is an overhead view of the jig of FIG. 3 adjusted and tightened to position door jambs at proper spacing and alignment for install to frame members of a doorway.

FIG. 4 is an overhead sectioned view of jig 300 of FIG. 3 taken along the section line AA. In this view, doorway frame members 301*a* and 301*b* (sectioned) are fixed locations that base template 100 locates off of and wherein alignment rail 200 locates off of. Door jambs 205*a* and 205*b* (sectioned) are located on either side of jig 300 mirror imaged in position and held flush to the doorway frame members relative to the Y axis by the adjusted and tightened jig 300. Locator pins 105*a* and 105*b* on base template 100, and locator pins 203*a* and 203*b* on alignment rail 200 maintain a uniform gap space between the door jambs and the doorway frame members.

Notches 204*a* and 204*b* in rail 200 align with notches 104*a* and 104*b* in template 100. The back edges of the rail notch patterns 205*a* and 205*b* ensure the door jambs are stacked flush and aligned with one another in a fore/aft scenario. In this embodiment, jig 300 may be assembled loosely (rail to template), the door jambs may be roughly placed, and then the alignment rail may be urged forward to stack the door jambs against the jig 300 and tightened to maintain the configuration while the jambs are being mounted to the inside surfaces of the vertical doorway frame members. The installer may loosen jig 300 at the rail and slide the rail backward to remove the jig from the finished doorway.

It is noted herein that the combined notch patterns in the base template and in the alignment rail define the profile of the inward facing side of the door jamb. In the embodiment described above, the door jamb style is a double-step jamb having a centered raise. However, other profile shapes of door jambs may be supported by jig 300 simply by providing the required notch patterns in the jig parts. In one embodiment, jig 300 may be used with single-step door jambs, or no-step door jambs, concave door jambs, or other custom shapes. It is noted that jig 300 may be provided for different door widths and doorway frame widths without departing from the spirit and scope of the present invention.

It will be apparent with skill in the art that the door jamb staging jig 300 of the present invention may be provided using some or all the elements described herein. The arrangement of elements and functionality thereof relative to the jig of the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. A jig for positioning door jambs for installation to a constructed doorway comprising:

a base template having a length, a width, and a height, and a surface area, the base template including side walls formed along the length of the base template material creating the height dimension;

a first pair of board locator pins spaced apart and parallel to one another mounted on the base template above the top surface of the base template, a pattern of the locator pins centered on the base template relative to the length of the base template;

a first pair of notch patterns disposed at opposing ends of the base template in mirror image to one another and aligned horizontally, each notch pattern adapted to conform to a step profile of a door jamb on one side of the constructed doorway;

a pair of slots placed through the surface area of the base template, the slots spaced apart and held parallel to one another, the pattern of the pair of slots centered relative to the length of the base template and the pattern of the board locator pins;

an alignment rail having a length, width, and height, the alignment rail including a side wall along one edge, the alignment rail adjustably mounted on the base template at the pair of slots using nut and bolt fasteners;

a second pair of locator pins spaced apart and parallel to one another mounted on the alignment rail a distance above a top surface of the alignment rail, the pattern of the locator pins centered on the alignment rail relative to the length of the alignment rail, the second pair of locator pins having same dimensions and spacing as the first pair of locator pins; and a second pair of notch patterns disposed at opposing ends of the alignment rail in mirror image to one another and aligned horizontally, each notch pattern adapted to conform to the step profile of the door jambs positioned for installation.

2. The jig of claim 1, wherein the base template and alignment rail are manufactured of aluminum sheet metal of a uniform thickness.

3. The jig of claim 1, wherein the length of the base template is greater than a width dimension of the constructed doorway, and wherein the outside edges of the first pair of locator pins brush the inside surfaces of the vertical doorway frame members centering the base template within the constructed doorway.

4. The jig of claim 3, wherein the length of the alignment rail is greater than the width dimension of the doorway frame, and wherein the outside edges of the second pair of locator pins brush the inside surfaces of the vertical doorway frame members centering the alignment rail within the doorway frame.

5. The jig of claim 1, wherein the first and second pair of locator pins are welded to the base template and alignment rail respectively.

6. The jig of claim 1, wherein the first and second pair of locator pins are mechanically mounted to the base template and alignment rail respectively.

7. The jig of claim 1, wherein the first and second pair locator pins are attachable and detachable to their respective mounting locations.

8. The jig of claim 1, wherein the pair of bolt fasteners are turn knobs that thread into nuts through one or more washers.

9. The jig of claim 1, further including four leveler points disposed two to each side wall of the base template, the leveler points contacting the floor when the jig is in use.

10. The jig of claim 1, wherein the first and second pairs of notch patterns conform to the stepped sides of the door jambs.

11. The jig of claim 1, wherein the locator pins are annular.

12. The jig of claim 1, wherein the locator pins are rectangular.

13. The jig of claim 1, wherein the first and second pairs of locator pins align with one another in the jig when the jig is fully assembled.

14. The jig of claim 1, wherein the first and second pair of locator pins are individually pivotally mounted and may be locked horizontal or unlocked and pivoted upward.

15. The jig of claim 1, adapted by the notch patterns for a door jamb with a double-step profile having a center raise defining the thickness dimension of the door jamb.

16. The jig of claim 1, adapted by the notch patterns for a door jamb with a single-step profile having an edge raise defining the thickness dimension of the door jamb.

17. The jig of claim 1, wherein before tightening the alignment rail to the base template, the alignment rail is urged along the slot track in the base template to stack both door jams to the opposing notch patterns in the base template.

18. The jig of claim 1, wherein bolt openings are provided through the alignment rail, the spacing of the bolt openings in the alignment rail substantially equal to the spacing of the slots in the base template.

19. The jig of claim 1, wherein the alignment rail is installed to the base template to stack the door jambs and is removed from the base template after the door jambs are installed to the constructed doorway.

* * * * *